US005231726A

United States Patent [19]

McKenney et al.

[11] Patent Number: 5,231,726

[45] Date of Patent: Aug. 3, 1993

[54] APPARATUS FOR WASHING FOLDING CHAIRS

[75] Inventors: Joseph McKenney, Blythwood; Arthur Luongo; Billy Payne, both of Chapin, all of S.C.

[73] Assignee: LM Manufacturing, Columbia, S.C.

[21] Appl. No.: 863,230

[22] Filed: Apr. 3, 1992

[51] Int. Cl.[5] ..... A46B 13/04

[52] U.S. Cl. ..... 15/88.3; 15/77

[58] Field of Search ..... 15/77, 88.3, 102, 302, 15/308, 88.2; 134/64 R, 122 R

[56] References Cited

U.S. PATENT DOCUMENTS

| | | | |
|---|---|---|---|
| 1,670,809 | 5/1928 | Hormel | 15/77 |
| 3,018,200 | 1/1962 | Huddle | 134/6 |
| 3,098,250 | 7/1963 | Creech | 15/77 |
| 3,178,745 | 4/1965 | Kleebauer | 15/77 |
| 3,444,867 | 5/1969 | Thornton | 134/126 |
| 3,464,080 | 9/1969 | Certo | 15/302 |
| 3,545,024 | 12/1970 | Randrup | 15/60 |
| 3,675,665 | 7/1972 | Sadwith | 134/46 |
| 3,694,847 | 10/1972 | Hetman et al. | 15/77 |
| 3,698,029 | 10/1972 | Pulliam | 15/88.3 |
| 4,042,993 | 8/1977 | Cervin | 15/88.3 |
| 4,129,919 | 12/1978 | Fitch et al. | 15/308 |
| 4,281,675 | 8/1981 | Pure | 134/125 |
| 5,143,102 | 9/1992 | Blaul | 134/113 |

*Primary Examiner*—Edward L. Roberts

*Attorney, Agent, or Firm*—Michael A. Mann

[57] ABSTRACT

Apparatus for washing folding chairs. The apparatus comprises a housing having a channel therethrough dimensioned for receiving a folded folding chair. A continuous conveyor belt conveys chairs through the channel as first one, then a second cylindrical brush assembly scrubs the alternate sides of the chair to loosen foreign matter, assisted by sprays of a cleaning liquid, from the chair's surfaces. Then, the chair passes between rinsing nozzles to rinse off the loosened foreign matter and cleaning fluid. The chair then exits the housing and passes between two perforated tubes blowing air on its sides to remove excess rinse water. The brushes both turn in the same direction so that one turns with the advancing chair and the other turns against the advancing chair for more thorough cleaning. Panels return the chair to the folded condition in the event it begins to unfold in the channel. Easily-removable, windowed apertures on both sides of the apparatus allow inspection of the progress of the chairs and access for maintenance.

25 Claims, 3 Drawing Sheets

APPARATUS FOR WASHING FOLDING CHAIRS

BACKGROUND OF THE INVENTION

1. Field of the Invention

The present invention relates to methods and apparatus for automatically washing a series of folding chairs.

2. Discussion of Background

Folding chairs are chairs that fold to an essentially flat configuration, usually by lifting the front of the seat from a horizontal unfolded position to a vertical folded position as the legs pivot with respect to each other. Folding chairs are often used in large numbers for events such as graduation ceremonies, weddings, concerts and so on. At these events, foreign matter can soil the chairs. "Foreign matter" includes traces of food and beverages, fingerprints, scuff marks, mud, bird droppings, tree sap, grass stains, blades of grass, and so on; essentially foreign matter is any matter not found on a clean chair.

Currently, folding chairs are cleaned manually in one of two ways. The first method involves the use of a brush and hose. The second uses a pressurized hose. Typically, a worker can clean 30–40 chairs per hour. The chairs are brought to a central location, for example, a rental agency or warehouse, where they are cleaned before sending them out again because cleaning them at the event location requires more time than practical for a large number of chairs. Then the chairs are either stored for the next use or sent to a new event site.

Although there are a number of apparatus for cleaning a series or set of objects, such as commercial dishwashers, car washes, grocery carts (U.S. Pat. No. 3,698,029), cafeteria trays (U.S. Pat. No. 4,281,675), poultry shackles (U.S. Pat. No. 4,042,993), beverage cases (U.S. Pat. Nos. 3,675,665 and 3,018,200), bottles (U.S. Pat. No. 3,545,024), eyeglasses (U.S. Pat. No. 3,464,080), applicant is unaware of any apparatus for automatically cleaning folding chairs, in spite of the fact that folding chairs are routinely used by the hundreds and thousands at events, and inevitably require labor-intensive to clean between uses.

Notwithstanding the fact that a significant effort is required to clean large numbers of chairs, sometimes between use at closely-timed events, the problem of cleaning chairs quickly and cheaply has long gone unrecognized; that is, the need for an automatic chair-cleaning apparatus has not heretofore been recognized, as indicated by the absence, for example, of apparatus for this purpose.

Moreover, once the fact that large numbers of folding chairs must be cleaned is recognized, it can be appreciated that cleaning folding chairs automatically presents several problems. For example, folding chairs are symmetric left to right but not top to bottom or front to back. Furthermore, because they tend to loosen with use, the seat will readily pivot from the vertical folded to the horizontal unfolded positions. To be really useful, an apparatus for cleaning folding chairs should be portable, so that it can be taken to a location where the chairs have been used. It should be operable from readily-available power and water supplies. It should be efficient so that a large number of chairs can be cleaned in a short amount of time so that on-site cleanup of the chairs does not take an inordinate amount of time. Therefore, there is a need for an apparatus for cleaning a series of folding chairs, an apparatus that washes chairs thoroughly, quickly and cheaply.

SUMMARY OF THE INVENTION

According to its major aspects and broadly stated, the present invention is an apparatus for washing a folding chair or a series of folding chairs one after the other. The apparatus comprises a housing with a channel running from one end of the housing to the other. The channel is dimensioned for receiving a folding chair in the folded condition. One end of the channel is its entrance and the other is the exit. The housing has a conveyor for moving the chair through the housing. Inside the housing, foreign matter is separated from the chair by two cylindrical scrubbers with corresponding cleaning fluid nozzles, one following the other but on opposite sides of the channel, and a pair of rinsing fluid nozzles. The scrubbing portion of the channel is separated from the rinsing portion by a pair of linear, vertical brushes. A second set of linear, vertical brushes isolates the rinsing portion from the exit of the apparatus where blowers remove a portion of the rinse water from the exiting chair. Cleaning fluid, such as soapy water from a reservoir, is directed at the interface of the brushes and the chair so that the brush carries the fluid over the chair's surface. Rinse water is sprayed at the scrubbed chair as it is conveyed through the channel to remove cleaning fluid and loosened foreign matter.

There are several important features of the present invention. One of these is the use of two, off-set cylindrical brushes turning in the same direction. Two brushes are the necessary but minimum number of brushes to scrub the chair completely. However, if the brushes where placed opposite each other, the increased "pinch" pressure on the chair would necessitate greater power demand on the conveyor motor. Since the brushes are on opposite sides of the channel, they clean opposite sides of the chair. By turning in the same direction, both clockwise or both counterclockwise, the bristles of the brush on one side of the channel move in the direction of chair travel while the bristles of the opposing brush move against the direction of travel. If the brushes turned in opposing directions, their bristles would scrub the chair in the same direction (both in the direction of chair travel or both against the direction of travel) and the chair would not be cleaned thoroughly.

The spacing of the cylindrical brushes with respect to the channel and the length of the bristles are another important aspect of the invention. By placing the brushes so that their bristles cross deeply into the channel, the curves of the chair and the recesses of the back of the seat, are thoroughly cleaned.

Recycling the cleaning fluid is another important feature of the present invention. The fluid falls to the reservoir after being applied to the chair surfaces by the brushes and is pumped back to the cleaning nozzles. The fluid is not discharged immediately after use but, rather, is reused until dirty. Recycling minimizes fluid use and the quantity needed to be drained.

Another feature of the present invention is the dual function of the first set of vertical brushes. These brushes not only help confine soapy water to the scrubbing portion of the channel and rinse water to the rinsing portion of the channel, but the brushes retard the chair as it passes by the second cylindrical roller, which, as it turns, tends to push the chair ahead of the conveyor.

Still another feature of the present invention are the panels that guide the chair seat back to the folded position as a result of it unfolding when subjected to scrubbing or rinsing. If the seat were allowed to unfold, the apparatus would quickly jam or the chair would become bent or broken.

The removable, transparent side panels are another important feature of the present invention. The transparency enables the operators to observe the orderly progression of the chairs through the machine and to spot a problem quickly if one occurs. Operators can also observe the condition of the wash water and better determine when to flush and refill the reservoir. The removability of the panels allows the channel, the brushes and the jets to be easily cleaned and serviced.

The chairs are conveyed by pushing by using "dogs", small upstanding members carried by the conveyor, on a continuous-chain conveyor belt. The chairs are fed top end first and with the dog engaging the foot of one leg. This conveying method is an important feature of the present invention. The chairs are moved easily through the channel with minimum contact with the dog so the balance of the surface area of the chair is exposed for washing.

Yet another important feature of the present invention is the directing of the jets of cleaning fluid at the interface of the cylindrical brushes and the moving chair as the bristles turn into the chair, the cleaning fluid is applied immediately and uniformly to the chair surfaces and is not allowed to run down the chair or be thrown off by the spinning bristles.

These and other important features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

The present invention is an apparatus for washing folding chairs. The apparatus is portable and operates on household electric power and water supplied from a garden hose.

Figure 4:
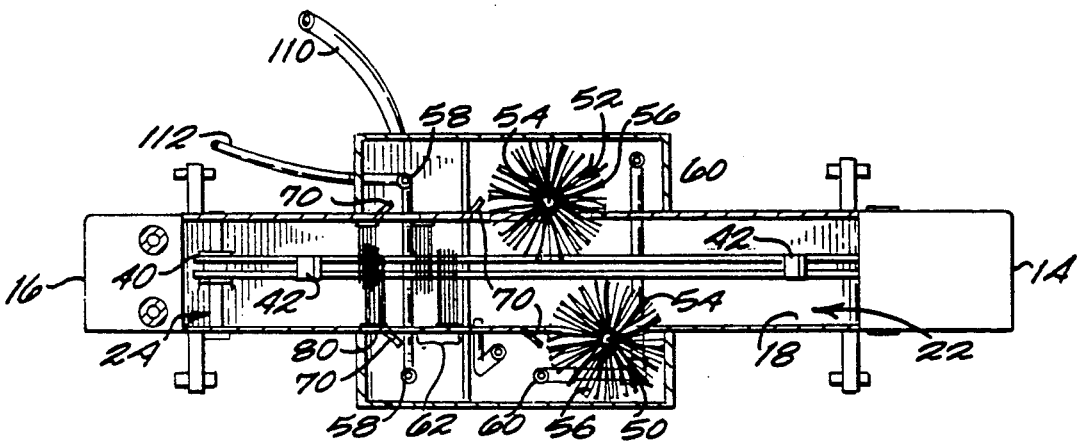
FIG. 4 is a top cross sectional view of the apparatus as shown in FIG. 1.
Figure 5:
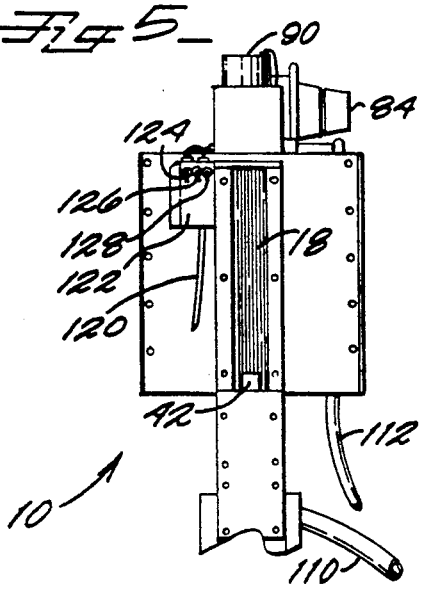
FIG. 5 is an entrance side view of the apparatus as shown in FIG. 1.
Figure 6:
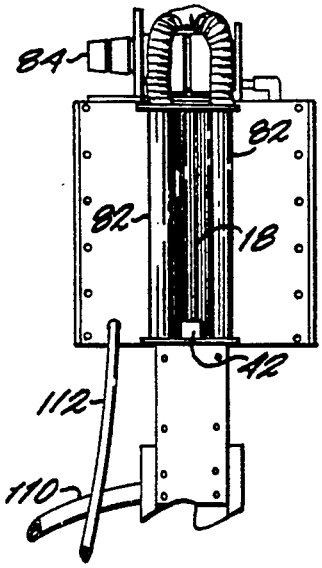
FIG. 6 is an exit side view of the apparatus as shown in FIG. 1.

Referring now to FIGS. 1–6, the apparatus, generally indicated by the reference numeral 10, has a rectangular housing 12 with a first end 14 and a second end 16 opposite the first end 14. As best seen in FIG. 4, a channel 18 runs the length of apparatus 10, from an entrance 22 at first end 12 to an exit 24 at second end 14. Chairs are fed in entrance 22 and removed from exit 24.

Housing 12 is preferably mounted to a frame 26 that has wheels 28 for convenience in moving apparatus 10 from place to place. On each side of apparatus 10 is an aperture 30 through which a portion of channel 18 may be viewed. A clear window 32 is fitted over aperture 30 or slid down into a gasketed channel formed in housing about the edge of aperture 30. Aperture 30 enables observation of the progress of a folding chair through apparatus 10, cleanliness of the washwater and the condition of the devices that clean the chairs. Aperture 30 also allows access to these devices for maintenance.

Inside housing 12 is a conveyor belt 40 having several dogs 42 attached to it for pushing folding chairs through housing 12. The chairs are loaded in a folded configuration, top end first, side-over-side (FIG. 2), so that dogs 42 engage one set of chair legs. In a preferred embodiment three dogs allow one chair to be entering, and one chair to be leaving, apparatus 10 at a time for convenient two-man operation.

Along channel 18, a chair will be engaged by a first cylindrical brush assembly 50 turning clockwise when viewed from above. A second cylindrical brush assembly 52, also turning clockwise, offset from first brush assembly 50 and on the opposite side of channel 18, engages the chair next. Brush assemblies 50, 52 preferably have a core 54 with a radius of approximately five centimeters and bristles 56 with a length of 12 to 13 centimeters. The center of core 54 is approximately 12 to 13 centimeters from the centerline of channel 18. Thus, bristles 56 extend approximately five centimeters across the channel centerline. Since a typical folding chair is about 7 centimeters wide when folded, bristles 56 sweep deeply into the curves and other features of a chair.

Because first brush assembly 50 and second brush assembly are mounted on opposing sides of channel 18 and both turn in the same direction, they will brush against a chair in opposite directions; that is, first brush assembly 50 will brush a chair against the direction of the chair's motion; second brush assembly 52 will brush a chair in the direction of motion. Brushing against a chair in opposite directions assures more thorough cleaning, especially of chair rungs. Offsetting or staggering one brush assembly with respect to the other assures that the brushes can be close enough to the chair to sweep deeply into the chair curves without applying their pressure of engagement simultaneously to the chair from both sides at the same time, pressure that would require a much heavier duty motor for moving conveyor belt 40.

On each side of channel 18, a set of cleaning nozzles 60 directs a flow of a cleaning fluid such as soapy water or a specially-formulated detergent at the interface of brush assemblies 50, 52 and the chair. As the cleaning fluid strikes the interface, bristles 56 carry the fluid onto the chair surface for thorough cleaning. If applied otherwise, the fluid either would run off the chair or be spattered by the turning bristles.

After being brushed with cleaning liquid, the chairs are rinsed by two opposing sets of rinse nozzles 58 that spray water, or other rinsing liquid, onto opposing sides of the chairs. The rinse water removes the cleaning fluid plus dissolved and loosened foreign matter. Rinse water may also contain protective chemicals that will prevent staining or ultraviolet light damage to plastic seating, for example.

Foreign matter includes dirt, scuff marks, spilled food and beverages, grass stains, blades of grass, bird droppings, tree sap, gum, and the like. The scrub/rinse work separates the foreign matter from the chair to clean it. The scrubbing by brushes loosens foreign matter and the rinsing carries it from the chair.

The portion of channel 18 where brushes 50, 52 scrub the chairs as they are conveyed is separated from the rinsing portion by a first pair of vertical baffles 62. First baffles 62 are preferably made of bristles 64 bound in a linear array to a holder 66. First baffles 62 are mounted to extend bristles 64 across channel 18 and serve two purposes: They limit the amount of cleaning fluid that enters the rinsing portion and, because second cylindrical brush assembly 52 brushes a chair in the direction it is conveyed, first baffles 62 prevent chair from getting ahead of dog 42.

Because apparatus 10 is especially suited for washing folding chairs, provision is made to maintain the chairs in the folded condition so that the seat of the chairs does not unfold and jam apparatus 10 or become damaged. Panels 70 are designed to guide the chair back into channel 18 should a chair be driven off course by first and second cylindrical brushes 50, 52 or the pressure of rinse nozzles 58. Panels 70 are located just following brushes 50, 52 and nozzles 58.

A second pair of vertical baffles 80, similar to first pair 62, wipe some of the excess of rinse water from the chair just before it leaves channel 18 at exit 24. At exit 24 are a pair of tubes 82 connected to a source of forced air, such as blower 84 mounted on top of housing 12. Each tubes 82 has an array of holes 86 through which the air flows against the exiting chair to blow additional excess water from the chair surfaces so that it will dry more quickly. Optionally, a heater may be added or a device for causing air to be directed in a swirling motion to remove additional rinse water.

Figure 1:
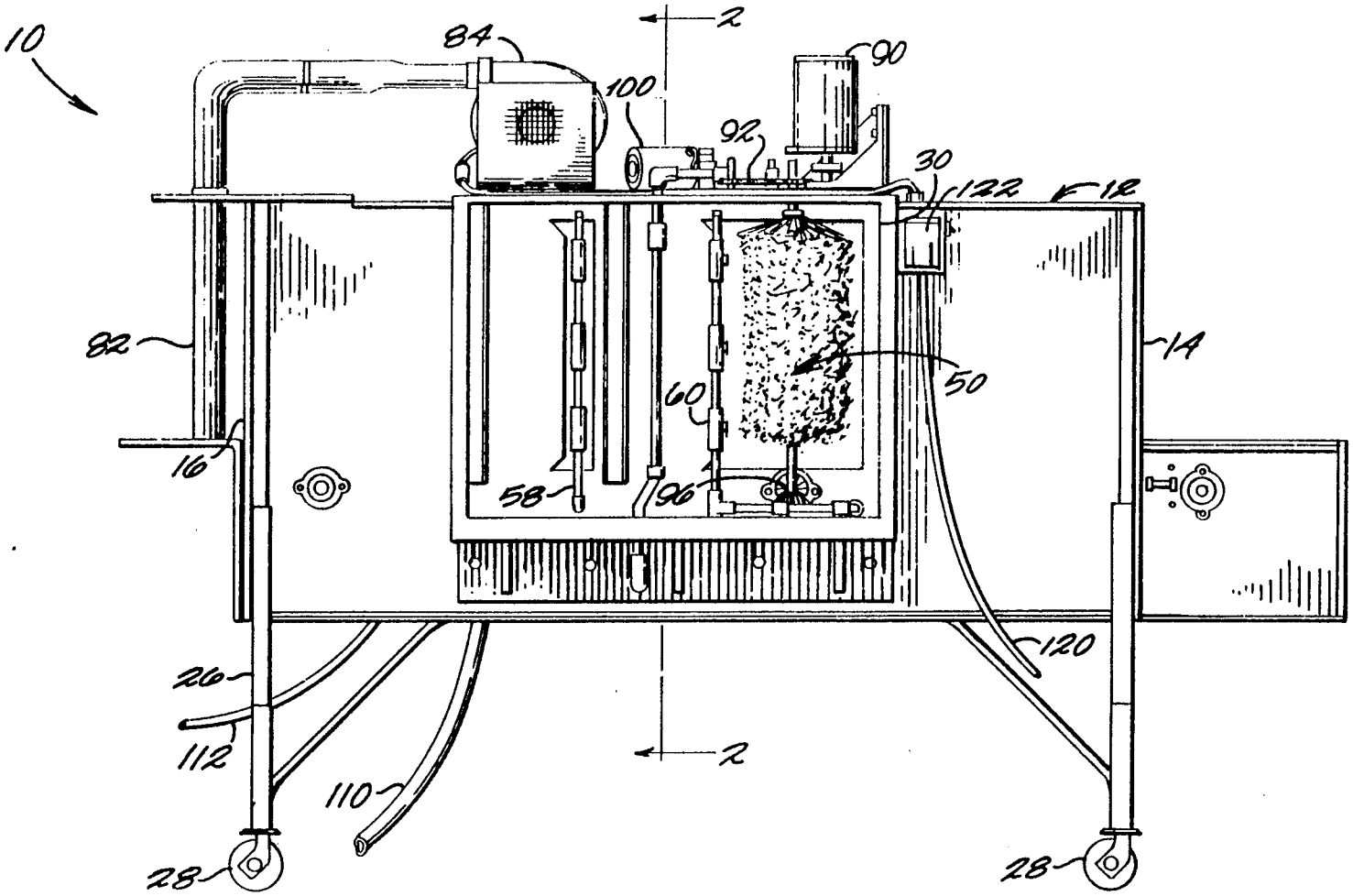
FIG. 1 is a side elevation of an apparatus according to a preferred embodiment of the present invention.
Figure 2:
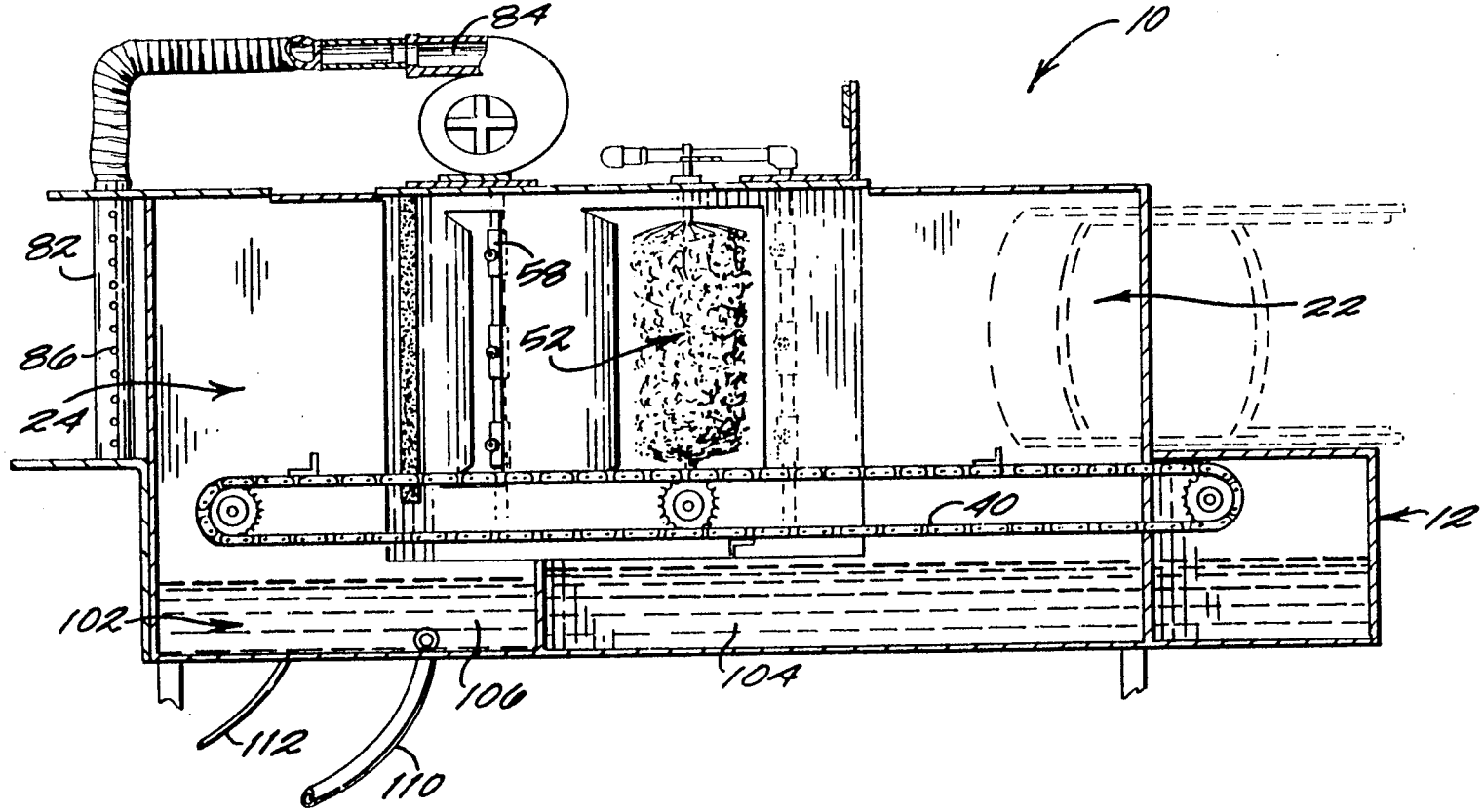
FIG. 2 is a side cross-sectional view of the apparatus shown in FIG. 1.
Figure 3:
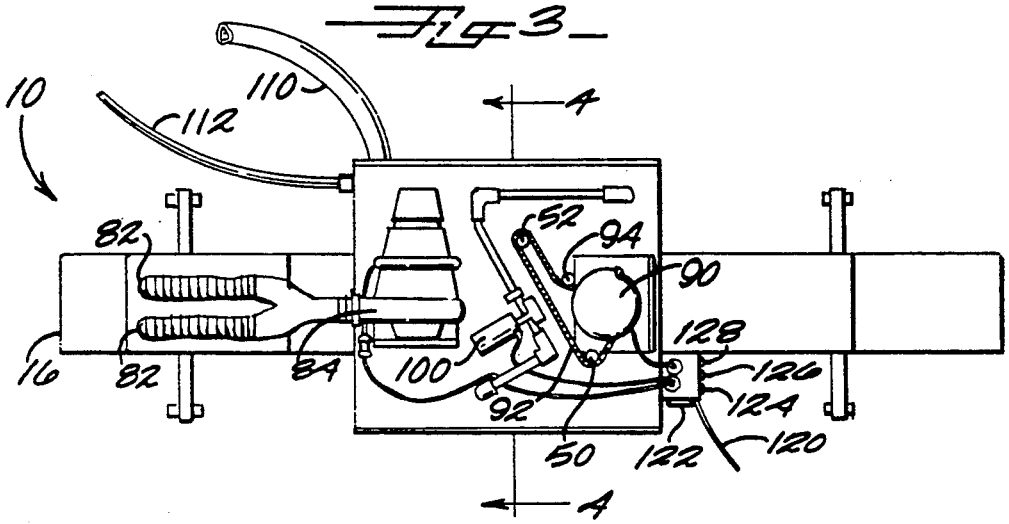
FIG. 3 is a top view of the apparatus of FIG. 1.

An electric gear motor 90 is mounted to the top of housing 12. Motor 90 rotates first and second cylindrical brush assemblies 50, 52 via a chain 92 and take up sprocket 94. The turning of first brush assembly 50 is transferred by a right angle gear 96, mounted to the base of assembly 50 as seen in FIG. 1, to drive conveyor belt 40.

A pump 100, also mounted to the top of housing 12, pumps cleaning fluid from a reservoir 102 at the bottom of housing 12 to cleaning nozzles 60. Reservoir 102 receives used cleaning fluid which will be reused until it appears to be too dirty to be effective. Reservoir 102 is separated into two compartments, a first compartment 104 for cleaning fluid and a second compartment 106 for rinsing fluid. Second compartment 106 dumps excess into first compartment 104. A drain hose 110 removes excess cleaning fluid from apparatus 10 to a convenient drain (not shown). A water supply hose 112, such as a simple garden hose, supplies make-up water directly to rinse nozzles 58. Recycling cleaning fluid minimizes the total amount needed for washing the chairs and for draining from apparatus 10.

Electric power for motor 90 and pump 100 is supplied from a source of conventional, household power through a power line 120 to control box 122 which has three switches (best seen in FIG. 3): pump on/off 124, power on/off 126 and water on/off 128.

In use, the water switch is turned on to allow reservoir 102 to fill. Then the pump and power switches 126, 128 are turned on which causes nozzles 58, 60 to operate as cleaning fluid and rinsing fluid spray into channel 18. Conveyor belt 40 begins to move when power switch 126 is moved to the "on" position.

A chair is placed in channel 18, top end first, in folded position and side-over-side. As soon as the next dog 42 is brought around by conveyer belt 40, it will push the chair through channel 18. First one side of the chair will be cleaned by first cylindrical brush assembly 50 with cleaning fluid, then the other side of the chair will be cleaned by second cylindrical brush assembly 52, both brush assemblies 50, 52 turning clockwise and having cleaning nozzles 60 direct a spray of cleaning fluid at the interface between the chair and brush assemblies 50, 52. The chair will be advanced by conveyor belt 40, retarded slightly by first vertical baffles 62 as it leaves the scrubbing portion of chamber 18 for rinsing portion where rinsing nozzles 58 direct a spray of rinse water at the chair. As the chair continues its advance, it passes through second vertical baffles 80 toward exit of channel 18 where air is blown by blower 84 through holes 86 in tubes 82 to remove excess rinse water from the chair.

It will be apparent to those skilled in the art that many changes and substitutions can be made to the preferred embodiment herein described. For example, the pump could be a submersible pump, the direction of rotation of the brush assemblies could be reversed and the drying means could be more elaborate and include heaters to remove even more excess rinse water from the exiting chair. Additional brush assemblies could be added. The cleaning fluid could be a special formulation designed specifically for the foreign matter most commonly encountered rather than an all-purpose detergent. All of these and other changes and substitutions are part of the invention and do not depart from the spirit and scope of the present invention as defined by the appended claims.

What is claimed is:

1. An apparatus for cleaning a folding chair, said folding chair having a folded position and an unfolded position, said folding chair openable and closable between said folded and unfolded positions, said chair having a leg, said apparatus comprising:

a housing having a channel therethrough, said channel dimensioned for receiving said chair, said housing having a first end and a second end, said first end of said housing defining an entrance to said channel, said second end of said housing defining an exit from said channel;

means engaging said leg of said chair for pushing said chair through said channel from said entrance to said exit, said chair being pushed through said channel in said folded position;

means for closing said folding chair to said folded position if said folding chair opens from said folded position as said chair is pushed by said pushing means through said channel; and means carried by said housing for separating foreign matter from said chair, said separating means separating said foreign matter from said chair in said channel.

2. The apparatus as recited in claim 1, wherein said housing further comprises means removably attached in said housing between said first end and said second end for observing said channel and said chair being conveyed therethrough and for providing access to said channel.

3. The apparatus as recited in claim 1, wherein said separating means further comprises:

means for scrubbing said foreign matter to loosen said foreign matter from said chair; and means for rinsing said foreign matter from said chair.

4. The apparatus as recited in claim 1, wherein said separating means further comprises:

a reservoir for containing a cleaning fluid;

means in fluid communication with said reservoir for directing a stream of said cleaning fluid at said chair as said chair is conveyed through said channel to clean said foreign matter from said chair; and means in spaced relation to said directing means for removing said cleaning fluid from said chair.

5. The apparatus as recited in claim 1, wherein said chair has a first side and an opposing second side, and said separating means further comprises:

first means for scrubbing said first side of said chair as said chair is conveyed through said channel; and second means for scrubbing said second side of said chair as said chair is conveyed through said channel, said first scrubbing means off-set from said second scrubbing means by positioning said second scrubbing means nearer to said second end of said apparatus than said first scrubbing means, said first scrubbing means positioned on a first side of said channel and said second scrubbing means positioned on a second side of said channel opposing said first side of said channel.

6. An apparatus for washing a folding chair, said chair having a leg, said chair having a first side and an opposing second side, said chair having a folded position and an unfolded position, said chair movable between said folded and said unfolded positions, said apparatus comprising:

a housing having a channel therethrough, said channel dimensioned for receiving said chair, said housing having a first end and a second end, said first end of said housing defining an entrance to said channel, said second end of said housing defining an exit from said channel;

means in spaced relation to said channel and engaging said leg for pushing said chair through said channel from said entrance to said exit;

means carried by said housing for scrubbing said first side of said chair;

means carried by said housing for scrubbing said second side of said chair, said second scrubbing means off-set from said first scrubbing means;

a reservoir for containing a cleaning fluid; and means in fluid communication with said reservoir and carried by said housing for spraying said cleaning fluid on said chair as said chair is conveyed through said channel.

7. The apparatus as recited in claim 6, further comprising means carried by said housing and in spaced relation to said spraying means for closing said folding chair to said folded position if said folding chair opens from said folded position.

8. The apparatus as recited in claim 6, wherein said housing has an aperture between said first end and said second end, and said housing further comprises window means removably attached to said housing through which said chair can be observed being conveyed and for providing access to said channel.

9. The apparatus as recited in claim 6, wherein said spraying means is positioned in spaced relation to said first and second scrubbing means, and said apparatus further comprises:

means following said first and second scrubbing means for rinsing said first and second sides of said chair as said chair is conveyed through said channel; and means separating said first and second scrubbing means from said rinsing means thereby defining a scrubbing portion of said channel and a rinsing portion of said channel, said separating means limiting fluid communication between said scrubbing portion and said rinsing portion.

10. The apparatus as recited in claim 6, wherein said spraying means directs said cleaning fluid at the interface of said first side of said chair and said first scrubbing means and the interface of said second side of said chair and said second scrubbing means so that said cleaning fluid is applied to said first and second sides of said chair.

11. The apparatus as recited in claim 6, wherein said pushing means further comprises:

a continuous conveyor belt;

means in operational connection with said belt for driving said continuous belt; and means carried by said continuous belt for engaging said chair, said engaging means pushing said chair through said channel.

12. The apparatus as recited in claim 6, wherein said first scrubbing means further comprises a first cylindrical brush having a core and a multiplicity of bristles radiating from said core, said first brush positioned adjacent said channel, said bristles extending deep enough into said channel to engage said first side, and said second scrubbing means further comprises a second cylindrical brush having a core and a multiplicity of bristles radiating from said core, said second brush positioned adjacent said channel, said bristles extending deep enough into said channel to engage said second side.

13. The apparatus as recited in claim 6, further comprising means carried by said housing and positioned closer to said second end than said second scrubbing means for removing at least a portion of said cleaning fluid from said chair.

14. The apparatus as recited in claim 6, further comprising:

means following said first and second scrubbing means for rinsing said first and second sides of said chair with water as said chair is conveyed through said channel; and means for removing at least a portion of said water from said chair.

15. The apparatus as recited in claim 6, further comprising:

means following said first and second scrubbing means for rinsing said first and second sides of said chair with water as said chair is conveyed through said channel;

means for isolating said cleaning fluid from said water for rinsing, said first isolating means defining a scrubbing portion and a rinsing portion of said channel, said rinsing means positioned in said rinsing portion and said first and second scrubbing means positioned in said scrubbing portion, said conveying means adapted for pushing said chair through said separating means;

means positioned following said rinsing means for removing at least some of said water from said chair; and means positioned following said rinsing means for confining at least some of said water to said rinsing portion of said channel.

16. An apparatus for cleaning a chair having a folding seat, said chair having a top end, legs, a first side, an opposing second side, an open position with said seat unfolded and a closed position with said seat folded, said apparatus comprising:

a housing having a channel therethrough, said channel dimensioned for receiving said chair, said housing having a first end and a second end, said first end of said housing defining an entrance to said channel, said second end of said housing defining an exit from said channel;

means for conveying said chair through said channel from said entrance to said exit;

first brush for scrubbing said first side of said chair as said chair is conveyed through said channel;

second brush for scrubbing said second side of said chair as said chair is conveyed through said channel, said first brush positioned closer to said entrance than said second brush, said first brush positioned on one side of said channel and said second brush positioned on an opposing side of said channel so that said first side of said chair is brushed by said first brush and said second side of said chair is brushed by said second brush as said chair is conveyed through said channel.

17. The apparatus as recited in claim 16, further comprising means for directing a flow of cleaning fluid at said chair, said directing means directing said cleaning fluid at said first side of said chair at the interface of said chair and said first brush and at said second side of said chair at the interface of said second side and said second brush.

18. The apparatus as recited in claim 16, further comprising means for guiding said chair through said channel, said guiding means maintaining said chair in said folded position as said chair moves through said channel.

19. The apparatus as recited in claim 16, wherein said first brush and said second brush turn in the same direction so that, as said chair passes between them, said first brush sweeps toward said top end of said chair and said second brush sweeps toward said legs of said chair.

20. The apparatus as recited in claim 16, wherein said first brush has a multiplicity of bristles and said second brush has a multiplicity of bristles, said multiplicities of bristles of said first and second brush assemblies each extending across said channel so that, as said chair passes through said channel, said multiplicities of bristles sweep deeply against said chair.

21. An apparatus for cleaning a chair, said chair having a leg, said apparatus comprising:

a housing having a channel therethrough, said channel dimensioned for receiving said chair, said housing having a first end and a second end, said first end of said housing defining an entrance to said channel, said second end of said housing defining an exit from said channel;

means engaging said leg of said chair for pushing said chair through said channel from said entrance to said exit;

means carried by said housing for separating foreign matter from said chair, said separating means separating said foreign matter from said chair in said channel, said separating means having first means for scrubbing said first side of said chair as said chair is pushed through said channel, and second means for scrubbing said second side of said chair as said chair is pushed through said channel, said first scrubbing means off-set from said second scrubbing means by positioning said second scrubbing means nearer to said second end of said apparatus than said first scrubbing means, said first scrubbing means positioned on a first side of said channel and said second scrubbing means positioned on a second side of said channel opposing said first side of said channel.

22. The apparatus as recited in claim 21, wherein said chair is a folding chair, said folding chair having a folded position and an unfolded position, said folding chair openable and closable between said folded and unfolded positions, said chair being pushed through said channel in said folded position, and said apparatus further comprises means for closing said folding chair to said folded position if said folding chair opens from said folded position as said chair is pushed by said pushing means through said channel.

23. The apparatus as recited in claim 21, wherein said housing further comprises means removably attached in said housing between said first end and said second end for observing said channel and said chair being pushed therethrough and for providing access to said channel.

24. The apparatus as recited in claim 21, wherein said first scrubbing means further comprises:

first means for scrubbing said foreign matter to loosen said foreign matter from said chair; and first means for rinsing said foreign matter from said chair; and wherein said second scrubbing means further comprises:

second means for scrubbing said foreign matter to loosen said foreign matter from said chair; and second means for rinsing said foreign matter from said chair.

25. The apparatus as recited in claim 21, wherein said separating means further comprises:

a reservoir for containing a cleaning fluid;

means in fluid communication with said reservoir for directing a stream of said cleaning fluid at said chair as said chair is conveyed through said channel to clean said foreign matter from said chair; and means in spaced relation to said directing means for removing from said cleaning fluid from said chair.

* * * * *